US012397217B1

(12) United States Patent
Householder

(10) Patent No.: US 12,397,217 B1
(45) Date of Patent: Aug. 26, 2025

(54) GOLF SWING BRACER

(71) Applicant: Jeffrey Allen Householder, Shiloh, IL (US)

(72) Inventor: Jeffrey Allen Householder, Shiloh, IL (US)

( * ) Notice: Subject to any disclaimer, the term of this patent is extended or adjusted under 35 U.S.C. 154(b) by 311 days.

(21) Appl. No.: 18/120,373

(22) Filed: Mar. 11, 2023

Related U.S. Application Data

(60) Provisional application No. 63/358,590, filed on Jul. 6, 2022.

(51) Int. Cl.
*A63B 69/36* (2006.01)

(52) U.S. Cl.
CPC ..... *A63B 69/3608* (2013.01); *A63B 2209/00* (2013.01)

(58) Field of Classification Search
CPC ..... A63B 69/3608; A63B 2209/00
USPC ..... 473/205–207, 213, 409
See application file for complete search history.

(56) References Cited

U.S. PATENT DOCUMENTS

| | | | | |
|---|---|---|---|---|
| 4,073,490 | A * | 2/1978 | Feather | A63B 21/4009 604/312 |
| 4,090,706 | A * | 5/1978 | Reda | A63B 21/0004 482/122 |
| 5,445,383 | A * | 8/1995 | Gleason, Jr. | A63B 69/3608 273/DIG. 30 |
| 5,553,324 | A | 9/1996 | Emerson | |
| 5,557,805 | A | 9/1996 | Emerson | |
| 5,743,838 | A * | 4/1998 | Willis | A63B 21/1609 482/125 |
| 5,745,920 | A * | 5/1998 | Olivier | A63B 21/4021 2/161.1 |
| 6,564,385 | B2 * | 5/2003 | McCarthy | A63B 21/4019 2/16 |
| 6,755,755 | B2 | 6/2004 | Wah Loh | |
| 7,731,597 | B1 | 6/2010 | Burgess | |
| 2009/0239674 | A1 * | 9/2009 | Huffman | A63B 69/3608 473/409 |
| 2010/0037363 | A1 | 2/2010 | Oakman | |
| 2014/0250630 | A1 | 9/2014 | Nugent | |
| 2017/0028286 | A1 | 2/2017 | Malkin | |

FOREIGN PATENT DOCUMENTS

| | | | |
|---|---|---|---|
| KR | 1020100055499 | A | 5/2010 |
| WO | 2011065756 | A2 | 6/2011 |

* cited by examiner

*Primary Examiner* — Nini F Legesse
(74) *Attorney, Agent, or Firm* — Grace J. Fishel

(57) ABSTRACT

A gripping method for holding a golf club grip comprising slipping a bracer with a band formed of an elastic material such as silicone over a golfer's lead hand and worn on the wrist. The bracer having a soft, breathable sheath that partially encircles the band with a gap between first and second ends. Stretching and releasing the band over the golf club grip such that the exposed elastic within the gap of the sheath has a hold on the golf club grip and the sheath pads the back of the golfer's hand. The method improving control of the golf club, improving hand gripping strength, and improving and consisticizing proper ulnar and radial deviation of the wrist during a golf swing.

4 Claims, 6 Drawing Sheets

GOLF SWING BRACER

BACKGROUND OF THE INVENTION

Field of the Invention

The present invention relates to a bracer that assists a golfer to consistently execute a golf club swing proficiently.

Brief Description of the Prior Art

The wrists play an important part of a golf swing and have three types of movements: flexion/extension, pronation/supination and radial/ulnar deviation. Focusing on radial/ulnar deviation wrist movements, radial deviation is using only the wrist to move the thumb toward the forearm while, for example, holding a golf club. When the thumb moves away from the forearm while using only the wrist, the wrist movement is ulnar deviation. Radial/ulnar deviation is the most crucial wrist movements when executing a golf club swing to control golf swing radius, to increase golf club head speed and to maintain golf club face centeredness with the golf ball upon impact.

BRIEF SUMMARY OF VARIOUS PREFERRED EMBODIMENTS OF THE INVENTION

This section provides a general summary of the disclosure, and is not a comprehensive disclosure of its full scope or all of its features.

In accordance with the various embodiments of the present invention, a gripping method for holding a golf club grip involves slipping a bracer, consisting of a band formed of a material having an elastic restoring force covered with a sheath, over a golfer's lead hand and worn on the wrist. Bracer may be worn by left-handed golfers or right-handed golfers and used with or without a golf glove. In a preferred embodiment, the sheath partially encircling the band has first and second ends separated with a gap. A second step involves stretching and releasing the band over the end of the golf club grip such that the exposed band within the gap of the sheath has a hold on the golf club grip.

In some applications the material having an elastic restoring force is silicone and the band has a width ranging from ¾" to 1" and a thickness of 2 mm and the sheath is formed of leather and is stitched along one side.

The band has a circumference in the range of 7 to 8 inches. For example, a circumference of 7" for golfers with smaller sized wrists and 8" for golfers with larger sized wrists.

The gripping method provides a number of different benefits including eliminating the golfer from having to excessively tighten their hand grip due to having a lack of hand gripping strength, thus allowing proper hinging of the wrists during the golfer's backswing. Other benefits include reducing ulnar deviation insufficiency and improving radial deviation muscle strength due to the elastic restoring force of the invention. The gripping method also assists new golfers to learn how much ulnar deviation and radial deviation to use during a golf swing.

The invention summarized above comprises the constructions and methods hereinafter described, the scope of the invention being indicated by the subjoined claims.

BRIEF DESCRIPTION OF THE SEVERAL VIEWS OF THE DRAWING

In the accompanying drawings in which one of various possible embodiments of the invention is illustrated, corresponding reference characters refer to corresponding parts throughout several views of the drawings in which.

DETAILED DESCRIPTION OF AT LEAST ONE PREFERRED EMBODIMENT OF THE INVENTION

Figure 2:
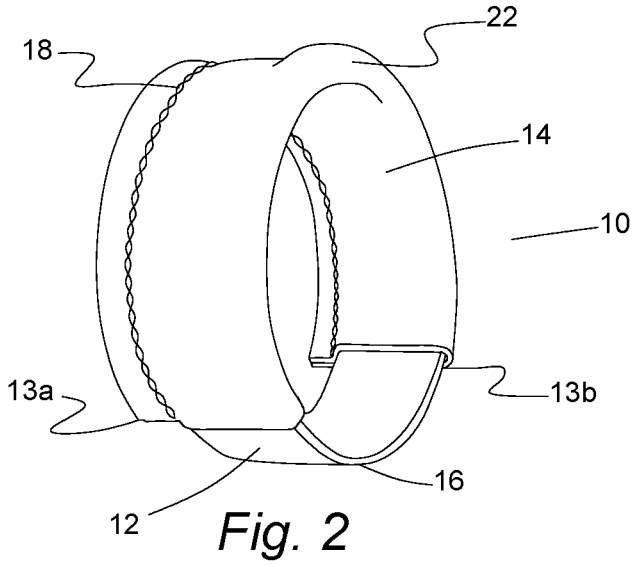
FIG. 2 is a perspective view of the golf swing bracer.

Referring to the drawings more particularly by reference character, a bracer 10 for use in accordance with the present invention is shown in FIG. 2. Bracer 10 is formed from a band 12 of a material having an elastic restoring force such as silicone. Band 12 has a diameter such that it may be easily slipped over a golfer's lead hand and onto his or her wrist. The circumference of the band is selected accordingly to fit the wrist and will vary per individual. Commercially this may be done with two optional width sizes and two optional circumference lengths. Satisfactory results for use of bracer 10 have been obtained with a silicone band 12 having a width of ¾" to 1", a circumference of 7" to 8" and a thickness of 2 mm. The preferred amount of resistance of the band 12 will also vary per individual and is determined by the nature of the material having an elastic restoring force, the width of the band, the circumference of the band and the thickness of the band. The width of the band may be narrower than ¾" or wider than 1" and the thickness of the band may be greater or lesser than 2 mm depending which aforementioned golf swing issue(s) the golfer is addressing which are explained in greater detail in the following description sections.

With continuing reference to FIG. 2, a sheath 14 partially encircles band 12 with first and second ends 13*a*-13*b* separated by a gap 16, the gap 16 exposing a section of the band 12. Sheath 14 may be formed of a strip of tactually pleasant, breathable material stitched 18 along one edge.

Stitched 18 edge may be in conjunction with adhesive. Some materials such as nylons, plastics or other synthetic materials may be used but the preferred material is a layer of natural soft leather as it is well suited having durable, breathable and moisture deterrent characteristics.

Figure 3:
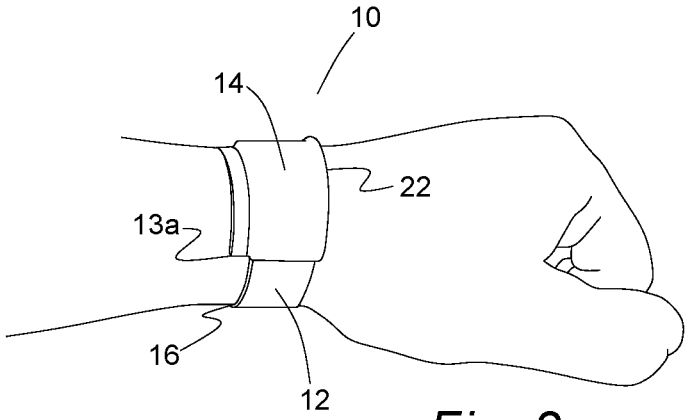
FIG. 3 is a side view of the golf swing bracer on the left wrist of a right-handed golfer.
Figure 4:
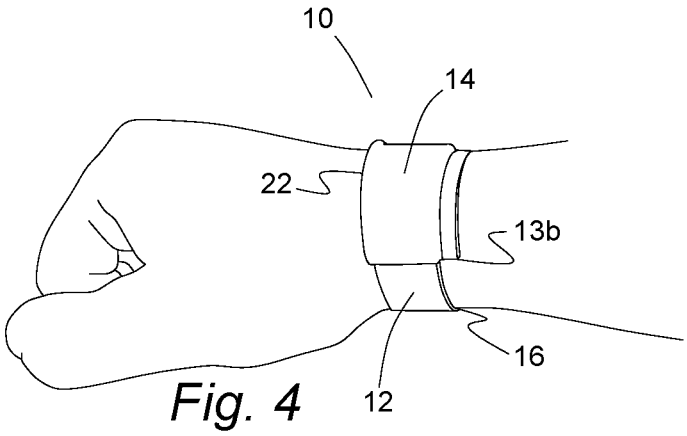
FIG. 4 is a side view of the golf swing bracer on the right wrist of a left-handed golfer.
Figure 5:
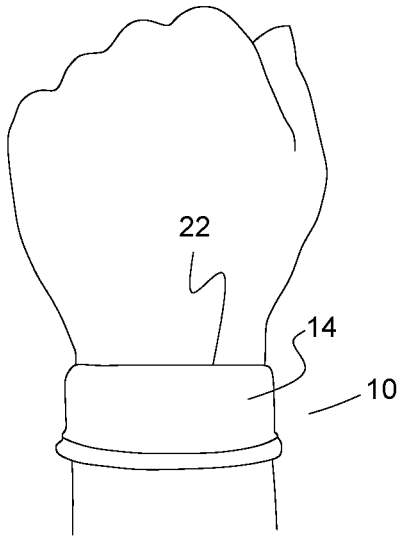
FIG. 5 is a top view (dorsal) of the golf swing bracer on the left wrist of a right-handed golfer.
Figure 7:
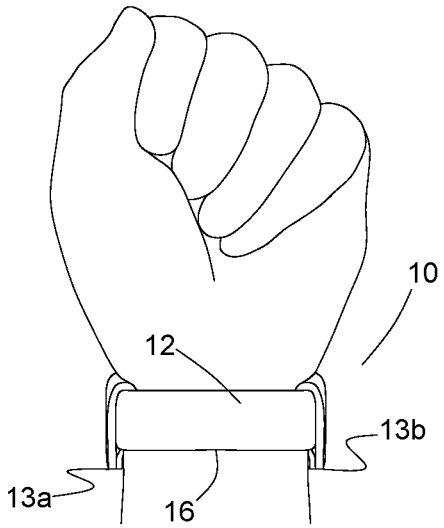
FIG. 7 is a bottom view (volar) of the golf swing bracer on the left wrist of a right-handed golfer.
Figure 6:
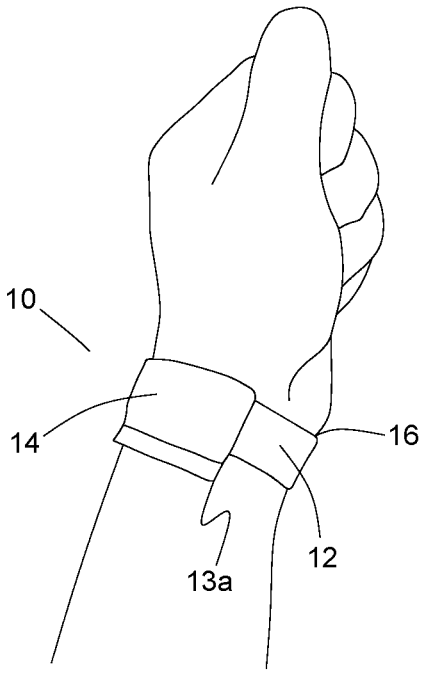
FIG. 6 is a side view (radial) of the golf swing bracer on the left wrist of a right-handed golfer.
Figure 8:
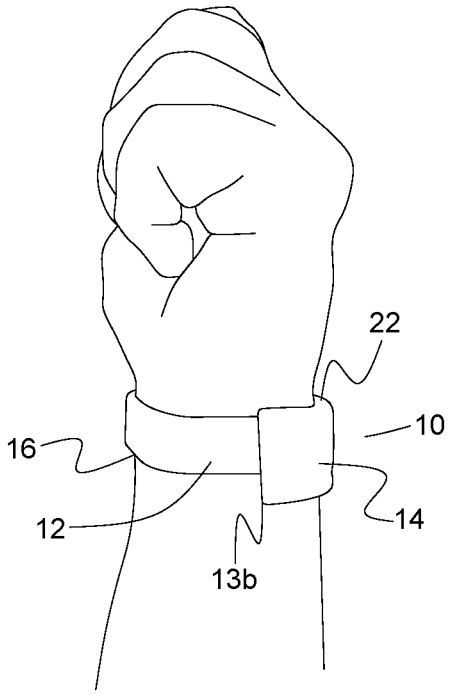
FIG. 8 is a side view (ulnar) of the golf swing bracer on the left wrist of a right-handed golfer.
Figure 9:
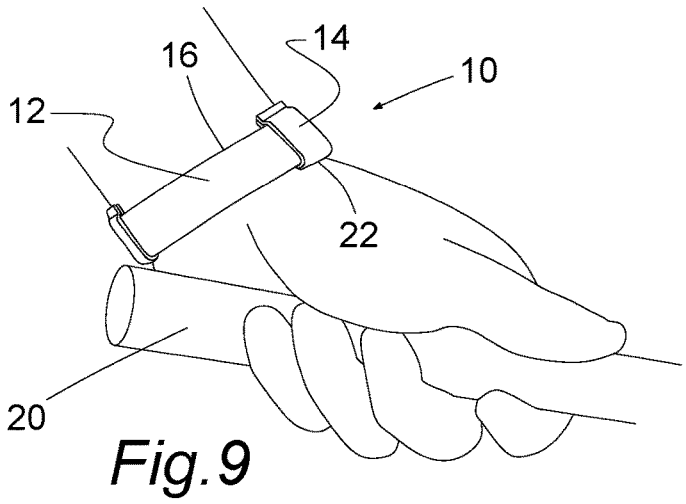
FIG. 9 is a side view (volar) of the golf swing bracer, when not in use, on the left wrist of a right-handed golfer holding a golf club.
Figure 10:
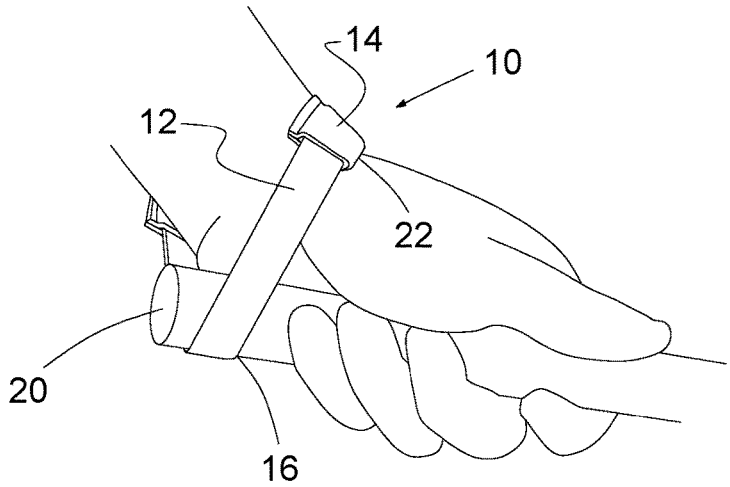
FIG. 10 is a side view (volar) of the golf swing bracer stretched over a golf club grip.

FIGS. 3-8 show bracer 10 on a golfer's lead hand with the stitched 18 edge of sheath 14 toward the user's elbow and the smooth, curvature edge 22 toward the thumb as shown in FIG. 3. In FIG. 9 bracer 10 is on the lead hand of a right-handed golfer when not in use. For use in accordance with the present invention as an Adaptive Golf Swing Apparatus or as Golf Swing Training Apparatus as described below, band 12 is stretched at the gap 16 in the sheath 14 and released over the end of a golf club grip 20 as shown in FIG. 10. The positioning of band 12 on the end of the golf club grip 20 is individual preference as golf clubs vary in diameter and length. The sheath 14 pressing over the top of the golfer's wrist is important, as it provides a soft, breathable cushion.

1. When Used as an Adaptive Golf Swing Apparatus

Figure 13:
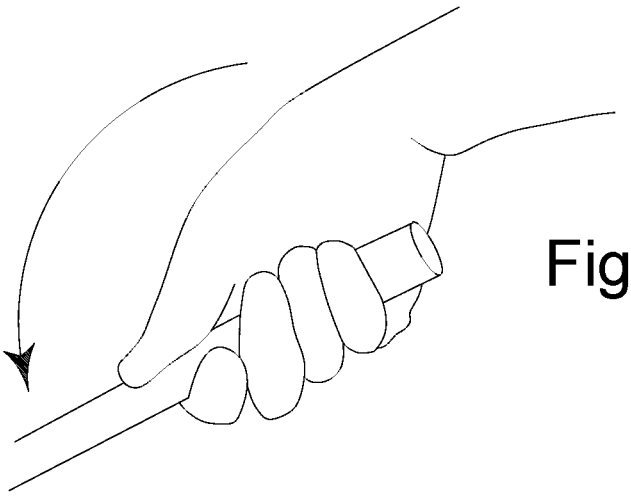
FIG. 13 shows the right hand of a golfer gripping a golf club grip with wrist in ulnar deviation.

Bracer 10 assists disabled, injured and elderly golfers who lack sufficient hand gripping strength, or who are unable to perform sufficient ulnar deviation (FIG. 13) in order to swing golf clubs properly and with confidence.

Insufficient Hand Gripping Strength

One example of the problems golfers have resulting from the lack of hand gripping strength is low ball speed due to the inability to grip the golf clubs tightly enough in order to execute a powerful downswing. Another example of the problems golfers have resulting from the lack of hand gripping strength is over-compensation by squeezing the golf club too tightly, restricting the proper hinging of the wrists needed when swinging golf clubs and resulting in a faulty putt when using a golf putter.

Ulnar Deviation Insufficiency

Golfers need to execute ulnar deviation (FIG. 13) at a precise moment during their downswing in order for the golf club face to make proper contact with the golf ball. Bracer 10 assists with ulnar deviation insufficiency during the golfer's downswing, as well as, assists with the natural timing thereof when to initiate ulnar deviation within the golf swing radius during the golfer's downswing by creating centrifugal force on the golf club head, resulting in a more precise un-hinging of the wrists in the exact proper moment.

2. When Used as a Golf Swing Training Apparatus

Bracer 10 assists new golfers who are learning to swing a golf club accurately and consistently by maintaining the exact same golf swing method each and every time (i.e. how much ulnar and radial deviation to use and precisely when to initiate ulnar and radial deviation during the golf swing) ultimately accelerating the development of muscle memory in less time and resulting in quickly mastering the proper golf swing.

Bracer 10 also assists experienced golfers who wish to change their golf swing method.

Radial Deviation

Figures 1, 1A:
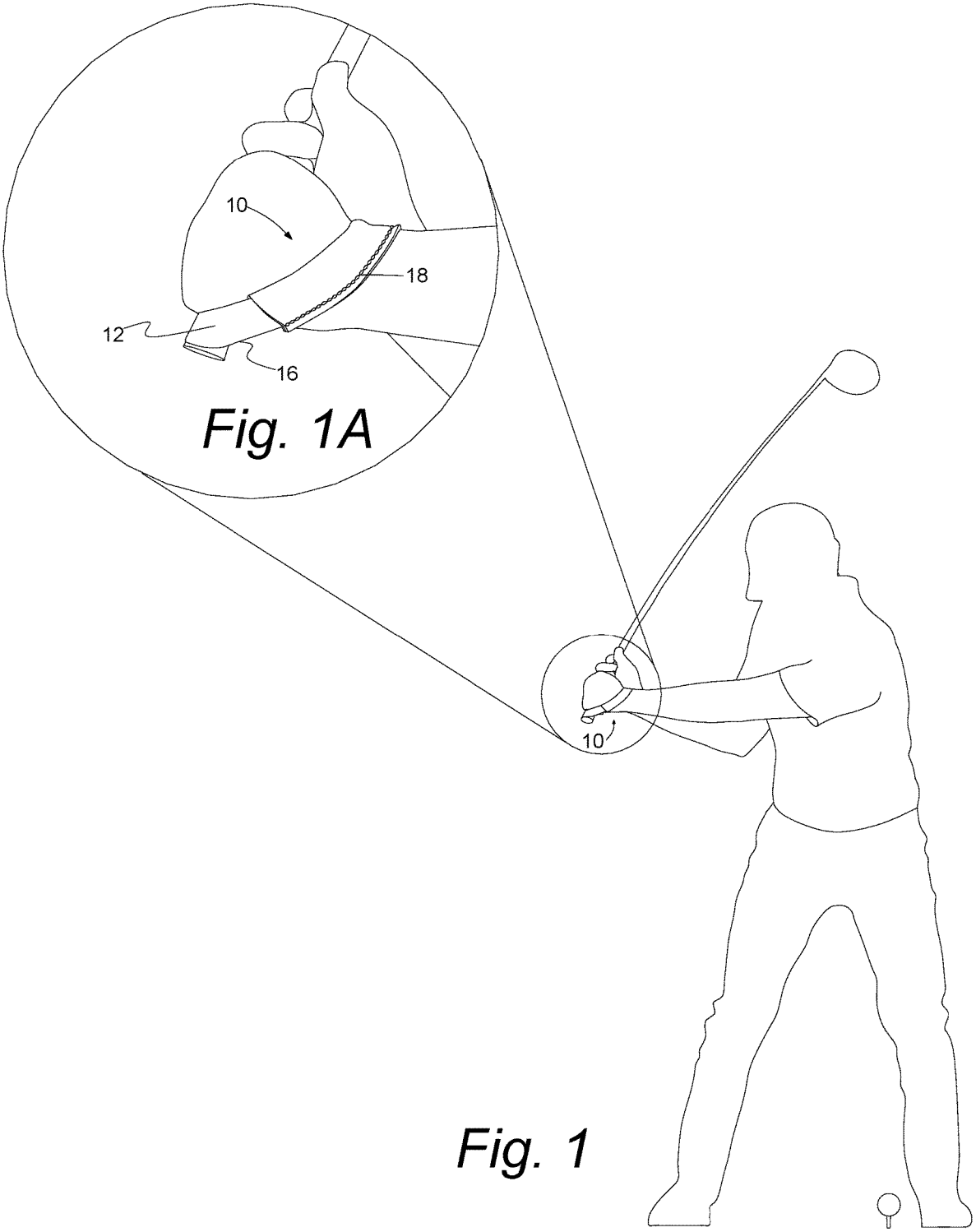
FIG. 1 showing a golf swing bracer being worn and the precise moment in a golfer's backswing when radial deviation is executed, which is also the same point in a golfer's downswing when ulnar deviation is executed.
FIG. 1A is an enlarged detail taken from FIG. 1.
Figure 11:
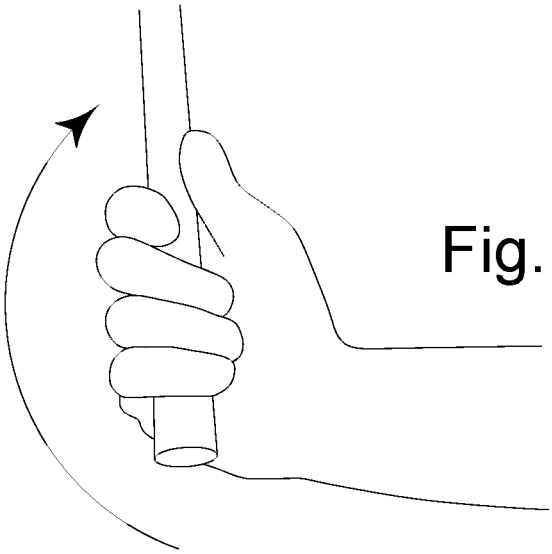
FIG. 11 shows the right hand of a golfer gripping a golf club grip with wrist in radial deviation.
Figure 12:
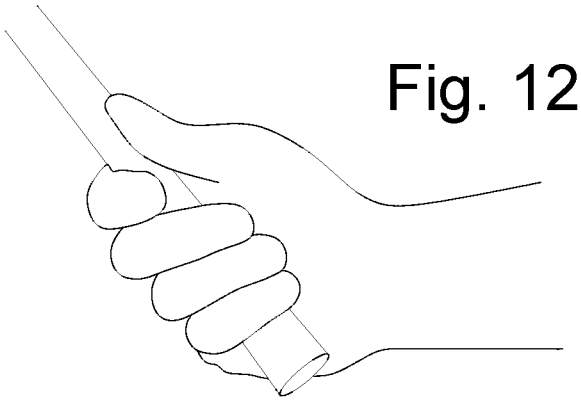
FIG. 12 shows the right hand of a golfer gripping a golf club grip with wrist in neutral position.
Figure 14:
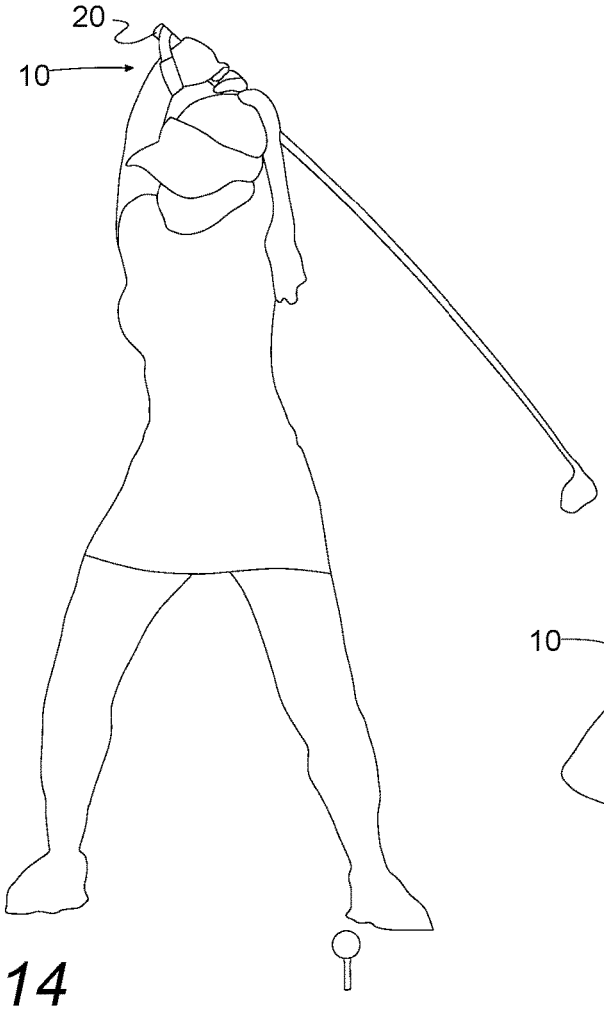
FIG. 14 illustrates the end of golfer's powerful backswing as viewed from the front; and, FIG. 15 illustrates the end of a golfer's powerful full swing as viewed from the rear.
Figure 15:
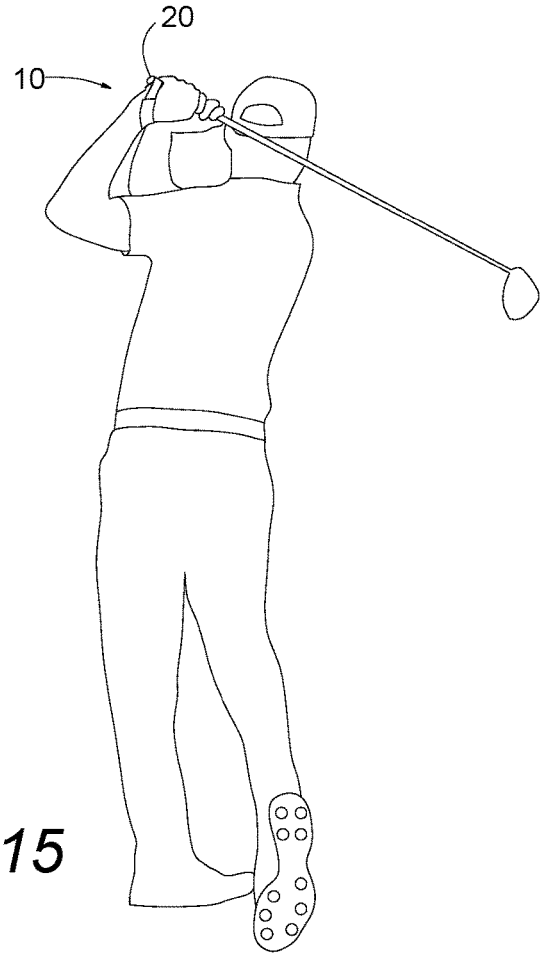

When golfers tee up their golf ball and position themselves into their golf swing stance, radial deviation (FIG. 11) is ever so slightly initiated in order for the golf club head to maintain a specific height from the ground in relevance to the golf ball height on the golf tee. Approximately midway during the golfer's actual backswing (FIGS. 1 and 1A) radial deviation is executed to the maximum range of motion, simultaneously resulting in bracer 10 to initiating maximum resistance created by elastic restoring force. Additionally, bracer 10 strengthens the muscles that execute radial deviation by means of resistance while the golfer is actually playing golf. In the same way, bracer 10 can also be used as an exercise apparatus off the golf course to strengthen the muscles that execute radial deviation. The radial deviation resistance and gripping method induced by bracer 10 also assists golfers in bringing the golf club to a full stop at the end of powerful backswings (FIG. 14) and at the end of powerful full golf swings (FIG. 15) as well as, helps to prevent the golf club from slipping out of golfers' hands during powerful backswings, powerful downswings and powerful full swings.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure.

What is claimed is:

1. A gripping method for holding a golf club grip comprising providing a band formed of a material having an elastic restoring force covered with a sheath, said sheath formed of leather and stitched along one side with a rounded opposite side edge, said band having a gap between a first and a second end exposing the band, slipping said band over a golfer's lead hand, positioning the band on the golfer's lead hand such that the stitched along one side of the band is towards an elbow of the golfer's lead hand and the rounded opposite edge is positioned between golfer's lead hand and the golfer's wrist, and, stretching the band in the gap over the end of the golf club grip such that the band in the gap has a hold on the golf club grip.

2. The gripping method of claim 1 further comprising providing a band wherein the material having an elastic restoring force is silicone and the band has a width range of ¾" to 1" and a thickness of 2 mm.

3. The gripping method of claim 1 further comprising providing a band wherein the band has a circumference of 7" to 8.

4. A gripping method for holding a golf club grip comprising providing a band formed of silicone with an elastic restoring force, said band covered with a sheath, said sheath formed of leather and stitched along one side with a rounded opposite side edge, said band having a gap between a first and a second end exposing the band, said band having a width of about ¾" to about 1" and a thickness of about 2 mm, slipping said band over the golfer's lead hand, positioning the band on the golfer's lead hand such that the stitched along one side of the band is towards an elbow of the golfer's lead hand and the round opposite edge is positioned between the golfer's lead hand and the golfer's wrist, said band having a leather sheath with first and second ends partially encircling the circumference of the band with a gap between the first and second ends exposing the band, said band having a width of about ¾" to about 1" and thickness of about 2 mm; and, stretching and releasing the band in the gap over the golf club grip such that the band in the cap has a hold on the golf club grip.

* * * * *